US009852565B2

(12) United States Patent
Engel-Dahan et al.

(10) Patent No.: US 9,852,565 B2
(45) Date of Patent: Dec. 26, 2017

(54) METHOD FOR OPERATING A LOCKING SYSTEM, LOCKING SYSTEM, AND TUBE SAFE

(71) Applicant: Lock Your World GmbH & Co. KG, Bad Orb (DE)

(72) Inventors: Manuela Engel-Dahan, Bad Orb (DE); Ralf Knobling, Schoeneck (DE); Thilo Meisel, Darmstadt (DE)

(73) Assignee: Lock Your World GmbH & Co. KG, Bad Orb (DE)

( * ) Notice: Subject to any disclaimer, the term of this patent is extended or adjusted under 35 U.S.C. 154(b) by 51 days.

(21) Appl. No.: 15/130,299

(22) Filed: Apr. 15, 2016

(65) Prior Publication Data

US 2016/0232729 A1 Aug. 11, 2016

Related U.S. Application Data

(63) Continuation of application No. PCT/EP2014/068184, filed on Aug. 27, 2014.

(30) Foreign Application Priority Data

Oct. 16, 2013 (DE) ..... 10 2013 111 429

(51) Int. Cl.
*G07C 9/00* (2006.01)

(52) U.S. Cl.
CPC ..... *G07C 9/00571* (2013.01); *G07C 9/0069* (2013.01); *G07C 9/00857* (2013.01);
(Continued)

(58) Field of Classification Search
CPC ..... G07C 2009/00492; G07C 2009/00634; G07C 2009/00761; G07C 2009/0088;
(Continued)

(56) References Cited

U.S. PATENT DOCUMENTS 4,609,780 A 9/1986 Clark
5,701,828 A 12/1997 Benore et al.
(Continued)

FOREIGN PATENT DOCUMENTS

CH 655351 A5 4/1986
FR 2741103 A1 5/1997

OTHER PUBLICATIONS

Lock Your World; Lock Your World secure. easy. stable; Dec. 5, 2011; www.LockYourWorld.com.

*Primary Examiner* — Yong Hang Jiang
(74) *Attorney, Agent, or Firm* — Reinhart Boerner Van Deuren P.C.

(57) ABSTRACT

A method for operating a locking system comprising an electronic key and an electronic lock and a central unit which in locking operation is used locally separately from the electronic key and the electronic lock, wherein in the method an external authorization code is generated by the central unit by means of an authorization code determination program, the external authorization code is transferred to the electronic key and the external authorization code is saved in a memory by the electronic key, wherein, on interaction of the electronic key with the electronic lock, the external authorization code is read out from the memory by the electronic lock and is checked by a processor of the electronic lock in that, using an internal authorization code determination program, the processor itself determines an internal authorization code and compares it with the external authorization code received by the electronic key and wherein, in the event of the determined internal authorization code being identical to the transferred external authorization code, the processor permits an opening process.

32 Claims, 12 Drawing Sheets

(52) U.S. Cl.
CPC . *G07C 9/00912* (2013.01); *G07C 2009/0088* (2013.01); *G07C 2009/00492* (2013.01); *G07C 2009/00634* (2013.01); *G07C 2009/00761* (2013.01); *G07C 2009/00936* (2013.01)

(58) Field of Classification Search
CPC ..... G07C 2009/00936; G07C 9/00571; G07C 9/0069; G07C 9/00857; G07C 9/00912
USPC ..... 340/5.6
See application file for complete search history.

(56) References Cited

U.S. PATENT DOCUMENTS

| | | | | |
|---|---|---|---|---|
| 6,082,153 | A * | 7/2000 | Schoell | E05B 47/0002 292/144 |
| 6,331,812 | B1 | 12/2001 | Dawalibi | |
| 2003/0179073 | A1 | 9/2003 | Ghazarian | |
| 2007/0290797 | A1 | 12/2007 | Harkins et al. | |
| 2008/0150684 | A1 | 6/2008 | Gartner | |
| 2013/0043973 | A1 * | 2/2013 | Greisen | G07C 9/00571 340/5.51 |

* cited by examiner

METHOD FOR OPERATING A LOCKING SYSTEM, LOCKING SYSTEM, AND TUBE SAFE

CROSS-REFERENCE TO RELATED PATENT APPLICATION

This application is a continuation of international application number PCT/EP2014/068184 filed on Aug. 27, 2014.

This patent application claims the benefit of International application No. PCT/EP2014/068184 of Aug. 27, 2014 and German application No. 10 2013 111 429.6 of Oct. 16, 2013, the teachings and disclosure of which are hereby incorporated in their entirety by reference thereto.

BACKGROUND OF THE INVENTION

The invention relates to a method for operating a locking system and to a locking system.

It is a general requirement for locking systems to combine the simplest possible operation with the highest possible security.

SUMMARY OF THE INVENTION

This problem is solved by a method for operating a locking system comprising an electronic key and an electronic lock and a central unit which in locking operation is used locally separately from the electronic key and the electronic lock, in that in the method an external authorization code is generated by the central unit by means of an authorization code determination program, the external authorization code is transferred to the electronic key and the external authorization code is saved in a memory by the electronic key, wherein, on interaction of the electronic key with the electronic lock, the external authorization code is read out from the memory by the electronic lock and is checked by a processor of the electronic lock in that, using an internal authorization code determination program, the processor itself determines an internal authorization code and compares it with the external authorization code received by the electronic key and wherein, in the event of the determined internal authorization code being identical to the transferred external authorization code, the processor permits an opening process.

An advantage of the method according to the invention can be considered to be that, with a plurality of electronic keys and a plurality of electronic locks, by outputting the external authorization code only one specific electronic key is capable of opening a specific electronic lock on input of this external authorization code.

A further advantage of the method according to the invention can be considered to be that, by determining an external authorization code and transferring this authorization code to the electronic key, it is possible to check, even prior to transfer of the electrical authorization code, whether the circumstances under which a request for such an authorization code by an operator is justified and thus the requirements for opening the electronic lock can already be locally clarified remotely from the electronic key and electronic lock.

Furthermore, in the method according to the invention, thanks to the external authorization code being determined by means of the central unit, misuse or improper opening by a user who has an electronic key available is not possible.

It is particularly favorable for the security of the method according to the invention if the authorization code determination program of the central unit determines the external authorization code in such a manner that only one-off opening is permitted therewith.

This in particular prevents an operator from saving the authorization code and attempting to reuse it.

The authorization code can be particularly straightforwardly determined as an authorization code with one-off validity by the authorization code determination program of the central unit if the authorization code is determined inter alia by taking account of a cycle counter in the central unit, wherein the cycle counter determines and records the opening processes of the electronic lock which is to be opened.

In order likewise to permit the authorization code determination program of the electronic lock to determine the correct internal authorization code, it is provided that the authorization code determination program of the electronic lock likewise determines the internal authorization code by taking account of a cycle counter.

It is furthermore preferably provided that the authorization code determination programs of the central unit and of the electronic lock determine the respective authorization code by taking account of the identification code of the electronic key which is used and of the identification code of the electronic lock to be opened.

In order to create the highest possible level of security, it is preferably provided that the authorization code determination programs determine the authorization codes by means of a hash algorithm.

In order to ensure that the authorization code determination program of the central unit and the authorization code determination program of the electronic lock are mutually independently capable of determining the authorization code on the basis of the same parameters and statuses, it is preferably provided that, prior to installation of the electronic lock at its intended location, the electronic lock is activated by the central unit, wherein in so doing the central unit matches the electronic lock identification code and the electronic lock cycle counter status with the electronic lock identification code saved in the central unit and the cycle counter status stored in the central unit.

The term "match" should be taken to mean that the corresponding data, i.e. for example the identification code and/or cycle counter status, are exchanged between the electronic lock and the central unit or read out from one of them and saved in the other of them.

It is preferably provided that the electronic lock identification code is stored in a secured memory.

It is furthermore preferably provided that, on activation of the electronic lock, the central unit matches passwords to be stored, in particular assignment passwords for the electronic key and the electronic lock, for example to one or more access groups, between the electronic lock and the central unit.

It is particularly advantageous for security if an assignment password is matched on activation of the electronic lock.

The assignment password is here intended to specify the assignment of the electronic lock to a specific group of locks and/or a specific group of keys.

An advantageous solution further provides that, on activation of the electronic key, the central unit matches the electronic key identification code with the electronic key identification code stored in the central unit.

In this case too, the term "match" should be taken to mean that the electronic key is exchanged between the two units or is read out from one unit and saved in the other unit or is simultaneously saved in both units.

It is particularly secure for use of the electronic key if, on activation of the electronic key, an assignment password is saved in the memory.

It is furthermore preferably provided that the electronic key identification code is stored in a memory of the electronic key.

It is preferably only possible to write to and read out from the electronic key memory when a security hash code is used.

It is here preferably provided that, to save the external authorization code, the security hash code is determined by a processor in the electronic key.

It is furthermore preferably likewise provided that, for reading out the external authorization code from the secured memory of the electronic key, a processor in the electronic lock generates a security hash code for accessing the secured memory.

No further details have hitherto been provided with regard to the nature of the secured memory.

A preferred solution accordingly provides using a memory of a security processor as the memory in the electronic key, wherein the security processor in particular requires generation of the security hash code for it to be possible to save data in the memory of the security processor, for example the authorization code and/or the identification code and/or passwords.

In order furthermore to prevent an attack proceeding on the electronic lock per se and the electronic lock at least displaying whether any relevant statuses can be achieved by an attack with an unauthorized electronic key, it is preferably provided that electronic lock status signals are transferred to the electronic key for display and thus in particular the electronic lock itself has no possibility to display its statuses.

In particular, it is provided that the electronic key has a processor which controls signal elements for displaying the electronic lock statuses transferred by the electronic lock.

One embodiment of a method for obtaining an access authorization in secured manner or for secured key handover for at least one user by means of an electronic lock and at least one electronic key carried by the user, in particular according to the features described below, comprises the following method steps:

transmission of at least one item of information which characterizes the electronic lock and/or the user to a central information processing facility or central unit arranged remotely from the electronic lock by means of a communication device, checking of the transmitted information by the central information processing facility, transmission of an authorization code to the user by means of the communication device in the case of the item of information being positively checked, input of the authorization code by the user into the carried electronic key by means of the input unit, unlocking of the electronic lock by interaction with the electronic key.

For example it is provided for this purpose that the item of information which characterizes the lock is formed by a number combination or by a barcode.

Alternatively or in addition, it is in particular provided that the item of information which characterizes the user is formed by a letter/number combination and/or by a password.

It is particularly favorable if, prior to transmitting an authorization code to the user, the information processing facility or the central unit checks, in addition to the item of information which characterizes the lock and/or the user, a time parameter linked to both items of information for the location of use and/or the time of use.

A convenient solution provides that the electronic lock is arranged on a locking lid of a tubular safe from which, once the electronic lock has been unlocked, a physical key is taken for accessing at least one further space.

It is furthermore conveniently provided that, on activation and/or deactivation, the electronic lock and/or the facility released thereby sends an item of information to the central information processing facility or the central unit.

A favorable solution provides that a mobile telephone is used as the communication device for transmitting the at least one item of information which characterizes the electronic lock and/or the user and/or for receiving the authorization code.

In particular, it is convenient if the communication device contains application software by means of which the at least one item of information which characterizes the electronic lock and/or the user can be acquired and/or by means of which the authorization code can be received and/or by means of which the authorization code can be transmitted to the electronic key.

One particularly advantageous variant is embodied in such a manner that the communication device and the electronic key form a unit.

A high level of security is achieved thanks to the checking of an item of information which characterizes the electronic lock, for example a code arranged in the region of the lock which is machine-readable by means of a communication device or manually by the user, and of an item of information which characterizes the user, for example a password or a letter/number combination input into the communication device, which are sent by means of a communication device to a central information processing facility arranged remotely from the lock and checked there. Access authorization is not checked and granted locally in the region of the electronic lock to be opened, but instead remotely therefrom in the information processing facility comprising the central unit.

Once the authorization code has been granted and transmitted, this authorization code is transferred to an electronic key carried by the user, by means of which the electronic lock is then unlocked. Transfer of the authorization code to the electronic key provides a further advantageous security barrier. Alternatively to manually inputting the transferred authorization code into the electronic key by means of an input device, the authorization code can also be transferred automatically from the communication device to the electronic key, for example by transfer by Bluetooth, an infrared transmitter or other short-range transmission method.

The electronic lock can in this case itself already permit access authorization to a protected region or a protected facility. In an alternative embodiment, however, the protected region is formed by a relatively small, burglar-proof container, for example a tubular safe, arranged on the outside of a building or in the vicinity of the building. In this tubular safe, the electronic lock, once opened by the electronic key, provides access to a physical key, by means of which the building can be accessed. The physical key is here particularly advantageously connected to the inner side of a tubular safe locking lid containing the electronic lock, such that the physical key is necessarily returned to the tubular safe once the building has been left and the tubular safe relocked by means of the locking lid.

According to a further advantageous use, once the authorization code has been checked, the electronic lock receives a voltage (optionally changed by a voltage transformer)

transmitted by an electrical voltage source of the electronic key and relays this voltage to an electrical motorized lock or an electrical actuator (optionally with interposition of a control device) for activation thereof.

In one particularly simple embodiment, the communication device is formed by a mobile telephone by means of which the user (for example a security service guard) calls the information processing facility (for example the security service control room) and transfers his/her name, an item of information specific to the lock and a password, whereupon the information processing facility checks these items of information, optionally additionally matches them with a shift plan on file and, in the event of a positive evaluation of all the items of information, transfers an authorization code to the user or the communication device. The user can be informed of the authorization code by telephone or also via a short message generated by a computer in the information processing facility.

The user transfers this authorization code via the input unit to the electronic key he/she carries with him/her and can then actuate the electronic lock with the electronic key by contact or by contactless signal transfer, for example via radio.

On the basis of this particularly simple embodiment, one or more of these steps can proceed automatically. Accordingly, the electronic lock code can for example be read out automatically by means of software (an "app") stored in the communication device and appropriate sensors (for example a camera of a smartphone serving as the communication device). This can for example proceed by means of a barcode reading program or Aztec code reading program stored in the smartphone, for which purpose an appropriate graphical code is in these cases arranged in the region of the electronic lock. However, other electronic signal generators arranged in the region of the electronic lock and sensors correspondingly directed thereto in the communication device, for example an invisible, magnetically encoded signal, are also possible.

The authorization code can also be transferred to the user's smartphone as a barcode, QR code or in a similar form. In the event that the transferred code is transferred in machine-readable form, this code is then transferred from the communication device (the smartphone) to an electronic input device on the electronic key.

The item of information which characterizes the user can also be requested automatically by the software stored in the communication device, for example after reading in the item of information specific to the electronic lock, and input by the user for example as a letter/number combination and transferred to the information processing facility.

A further advantageous method step provides that, prior to transmitting an authorization code to the user, the information processing facility checks, in addition to the item of information which characterizes the electronic lock and/or the user, an item of information linked to both items of information by a shift plan for the location of use and/or the time of use. This creates additional security because it also ensures that an access code will not be transferred completely outside a normal intended route of a security officer.

A further advantageous development of the invention provides that the electronic lock and/or the facility protected thereby sends an item of information to the central information processing facility on release and on locking of the electronic lock.

An advantageous further development of the system provides that the check in the central information processing facility furthermore includes an evaluation of at least one time parameter which verifies the item of information which characterizes the lock and/or the user on the basis of a timetable on file (in particular a guard's planned route) for the intended opening of the lock.

One particular development can provide that the communication device and the electronic key form a unit. This unit combines all the functions of a transmitter and receiver for acquiring and transmitting the items of information which characterize the lock and/or the user to a central information processing facility and for receiving an authorization code with the function of the electronic key. By means of the received authorization code, the electronic key, for example a magnetic transponder, is programmed such that it can be used for opening the electronic lock.

The present invention is for example usable in conjunction with a tubular safe, as for example disclosed in WO 2012/045474 A1. Once positioned on the electronic lock, the transponder as electronic key here directly serves as a handle for removing the locking lid.

The initially stated problem is furthermore solved by an electronic locking system comprising an electronic key and an electronic lock which are configured to be caused to interact with one another by a contact assembly and a mating contact assembly, wherein the electronic key has a processor which interacts with an input unit by means of which an externally generated authorization code is transferable to the processor, wherein the processor interacts with a memory and writes the externally generated authorization code into the memory and wherein the electronic lock has a processor which, on interaction of the electronic key with the electronic lock via the contact assembly and the mating contact assembly, interacts with the memory in the electronic key in order to read out the externally generated authorization code.

The advantage of the solution according to the invention has already been explained in connection with the method according to the invention and reference is therefore made thereto.

A further advantage can be considered to be that it is consequently possible to use the electronic key and the electronic lock with the highest possible security, without opening being possible solely with the electronic key and the electronic lock if the externally generated authorization code is not available.

In order to increase the security of the electronic key, it is preferably provided that the memory in the electronic key is a secured memory and that the electronic key processor generates a security code in order to save the externally generated authorization code in the secured memory.

In order also to ensure a high level of security when reading out the authorization code from the secured memory, it is preferably provided that the processor of the electronic lock generates a security code in order to read out the authorization code saved in the secured memory.

It is furthermore is preferably provided that the electronic key has display elements in order to display electronic lock statuses transferred from the electronic lock to the electronic key.

In this case it is conveniently provided that the processor of the electronic lock transfers status signals regarding the present electronic lock statuses to the electronic key processor and that the electronic key processor controls the electronic key display elements in accordance with the transferred statuses.

No further details have hitherto been provided with regard to the embodiment of the secured memory.

An advantageous solution accordingly provides that the secured memory is the memory of a security processor.

Such a security processor is preferably a processor which only permits access to the secured memory on transfer of a security code.

The security code can here conveniently be determined by a hash algorithm.

It could in principle be possible always to operate the electronic lock with an internal power supply.

An internal power supply however has the disadvantage that in this case, in particular when the electronic lock has not been used for an extended period, the voltage source will no longer provide sufficient voltage.

For this reason, it is conveniently provided that the electronic lock is operable by a voltage source of the electronic key.

The electronic lock could here additionally also have an internal voltage source and only be operable by the electronic key voltage source in the event of failure of the internal voltage source.

It is, however, particularly favorable if the electronic lock is always only operable with the voltage source of the electronic key, since in this case application of the voltage can also serve to start the functions of the electronic lock.

The solution according to the invention furthermore provides that the electronic lock comprises a locking drive for actuating a locking bolt.

In this case, the electrical lock is thus itself directly capable of triggering an opening process by actuation of the locking drive or locking by non-actuation of the locking drive.

In the event that the electronic lock has a locking drive, it is preferably likewise provided that the locking drive of the electronic lock is operable by the electrical voltage source of the electronic key.

In this case, it is conveniently provided that the electronic lock has a voltage transformer in order to operate the locking drive, since such a locking drive generally requires higher voltages than are required for operating the processors in the electronic key and in the electronic lock.

A further advantageous solution provides, as an alternative to the provision of an electrical locking drive in the electronic lock, that the electrical lock has a switch unit in order to activate and immobilize an external locking system.

In this case, the electronic lock does not itself serve directly to trigger or initiate a locking process or an opening process, but the electronic lock can instead serve to activate or immobilize an external locking system.

It is thus for example possible to make use of existing locking systems, which however have an inadequate level of security, by using the electronic key and the electronic lock.

These existing locking systems can consequently be brought to a higher level of security, namely the level of security of the electronic key or electronic lock, if the electronic lock activates or immobilizes the existing locking system.

A further advantageous solution provides that the electronic key has an interface for activating the electronic key by means of a central unit.

The central unit serves to generate the external authorization code, such that it is necessary for the central unit to activate the electronic key and thus to be aware of the electronic key data required for generating the authorization code.

It is furthermore provided that the electronic lock has an interface for activating the electronic lock by a central unit.

In this case, an activation is also required for the electronic lock in order also to put the electronic lock into a state which permits it to generate the external authorization code.

In particular, it is preferably provided that the electronic key and the electronic lock are activated by the central unit via a wired connection in order to achieve the greatest possible security against the data being received by third parties on activation.

An advantageous solution of an electronic key with at least two contacts for transferring data and/or energy to an electronic lock provides at least one input device provided on a housing of the electronic key for inputting an authorization code.

It is here advantageous if the input device and the contacts are arranged on different sides of the housing.

In particular, it is favorable for the input device to be arranged on a front side and the contacts on an opposing reverse side of the housing.

The electronic key is conveniently provided with at least one electrical voltage.

In particular, the electronic key is provided with at least one magnet for centering in cooperation with a corresponding counter-magnet on the electronic lock.

The contacts of the electronic key are furthermore mounted resiliently in the housing.

The electronic locking system furthermore comprises at least one electronic lock which is provided with at least two concentrically arranged mating contacts and magnetic centering means.

The mating contacts here in particular take the form of concentric circles which come into contact with the contacts of the electronic key in any desired relative angular position of the electronic key.

The electronic lock is conveniently arranged on a locking lid of a tubular safe, wherein the electronic key in contact with the electronic lock serves as a handle for actuation of the locking lid.

The electronic lock is, for example, located upstream of a motorized lock of a facility to be secured and activates current feed thereto.

It is, however, also conceivable for a control device to be arranged between the electronic lock and the motorized lock, current feed to which control device is activated by the electronic key on coming into contact with the electronic lock and successful verification of the authorization code input by means of the input unit.

It is furthermore preferably provided that the embodiments of the electronic locking system operate in accordance with the initially described method for operating a locking system.

The invention in particular makes it possible to provide an electronic key which can be activated briefly and alternately for opening the most varied locks.

An electronic key according to the invention here in particular advantageously interacts with at least one electronic lock.

An electronic key according to the invention is distinguished by an input unit arranged on a housing of the electronic key for inputting an authorization code. The input unit can here take the form of a numeric or alphanumeric keyboard, wherein the authorization code for the desired release is in this case input manually by the user.

According to a further aspect of the invention, the electronic key is programmable by means of authorization codes inputtable via the input unit for opening various electronic locks.

The input unit can alternatively or in addition also be formed by an electronic acquisition device. The latter can for example be formed by a reader or receiver which acquires an authorization code transferred by radio, Bluetooth, RFID or NFC communication or by optical transfer, for example of a barcode, QR code or the like, by the user or a communication device (for example a smartphone) operated by the user.

The authorization code is preferably buffered in a memory of the electronic key and, after contacting with an electronic lock, transferred to the latter via at least one contact.

The authorization code separately inputtable into the electronic key by means of the input unit outside the spatial vicinity of the electronic lock to be opened significantly increases security in the authentication of the access authorization, since the corresponding access data are largely impossible to intercept by unauthorized third parties and the electronic key is not brought close to the electronic lock until the authorization code has been completely input.

An electronic key which may have been stolen or lost is worthless to the thief or finder, who cannot identify the electronic lock for which the key in question has been prepared by the authorization code.

The input unit and contacts are preferably arranged on different sides of the housing. Particularly preferably, the input device is arranged on a front side of the housing and the contacts are arranged on a reverse side of the housing. As a consequence, the input device can also very straightforwardly be actuated in a position in which the contacts are in engagement with the respective mating contacts on the electronic lock.

The electronic key is particularly preferably provided with at least one electrical voltage source (preferably with a rechargeable storage battery) which not only acts as an internal power supply for the electronic components of the electronic key, but also serves to supply the electronic lock at least during the opening process or an initialization or activation process during which the electronic lock cannot be connected to an internal power supply.

The advantage is that the facility provided with the electronic lock does not have to be permanently supplied with an operating voltage, since the current required for opening is only supplied by the electronic key as required. Tubular safes installed off-grid in which physical keys are deposited can thus for example be operated not only without any fixed power supply but also without batteries which have to be replaced. Costs for maintenance and wear on these systems are consequently reduced.

Safe-deposit boxes, deposit boxes for valuables or safes can likewise be operated without a permanent power supply, since the current for initializing access is supplied by the electronic key. Once authentication of the access authorization has been confirmed, the electronic lock optionally here initially actuates a control device, by means of which an external operating voltage source for actuating a motorized lock or another actuator is activated.

The electronic key is preferably provided with at least one magnet (in particular an annular magnet) for centering in cooperation with a corresponding counter-magnet on the electronic lock. The mutually attracting magnetic forces automatically move the electronic key into the contact position as it approaches the electronic lock.

In order to assist formation of a reliable contact, the contacts on the electronic key are preferably mounted resiliently in the housing thereof.

Apart from the electronic key, the electronic locking system at least comprises the electronic lock which is provided with at least two concentrically arranged mating contacts and magnetic centering means.

According to one advantageous use of an electronic locking system, the electronic lock is arranged on a locking lid of a tubular safe, wherein the electronic key in the contact position thereof with the electronic lock preferably simultaneously serves as a handle for actuation of the locking lid.

According to an alternative use of an electronic locking system, the electronic lock is located upstream of a motorized lock or an actuator of a facility to be secured and activates current feed thereto. As has already been mentioned, safe-deposit boxes, deposit boxes for valuables or safes can be operated without a permanent power supply, since the current for initializing access is supplied by the electronic key.

Once authentication of the access authorization has been confirmed, the electronic lock optionally here initially actuates a control device, by means of which an external operating voltage source for actuating a motorized lock or another actuator is then activated.

The mating contact faces on the electronic lock preferably take the form of concentric circles which come into contact with the contacts of the electronic key in any desired relative angular position of the electronic key. Since the electronic key does not have to be rotationally aligned with the electronic lock, the electronic key is extremely simple to dock on the electronic lock by the user even when visibility is poor.

The invention furthermore also relates to a tubular safe comprising a tubular body and a tubular body lid, in which an electronic lock is arranged, in order to lock or unlock the tubular body lid in the locking position thereof inserted in the tubular body.

A key is preferably stored in the tubular body, since the latter generally serves as a key safe.

In order both to obtain simple access to the key and to be able to deposit the key simply in the tubular body without in particular the key becoming jammed with the tubular body lid when the latter is moved into the locking position, one embodiment of the tubular safe according to the invention provides that a key container is fitted on the tubular body lid which can be inserted into or removed from the tubular body with the tubular body lid.

The key container is here preferably constructed such that it has an accommodation space for a key, such that the key can be simply deposited in the key container and removed therefrom.

It is furthermore preferably provided that the key is secured to the key container against complete removal from the key container, so ensuring that the key is not lost while being used or inadmissibly removed from the key container.

A further advantageous solution provides that the accommodation space of the key container is accessible through an opening through which the key can be removed or inserted therein.

In order to ensure that the operator deposits the key container in the tubular body and specifically deposits the key container on locking of the tubular body in such a manner that the tubular body is locked by the tubular body lid, it is preferably provided that the position of the key container in the tubular body can be acquired by a sensor.

The sensor could be formed by any kind of sensor.

It is particularly simple and reliable if the sensor is a magnetic field sensor which recognizes a magnet fitted on the key container.

In order to be able to evaluate the sensor signal simply, it is preferably provided that the sensor interacts with a transfer unit which transfers a locking position of the tubular body lid to a security center, for example an above-stated central unit.

In order to be completely certain that the tubular body is properly closed by the tubular body lid, a further advantageous solution provides that a sensor is arranged on the tubular body which acquires a locking position of the tubular body lid in the tubular body.

In this case too, it is preferably provided that the tubular body lid is provided with a magnet, the position of which is acquired by the sensor.

This sensor also preferably interacts with the transfer unit already explained above, in order to communicate locking of the tubular safe to a security center or the initially stated central unit.

Further features and advantages of the invention constitute the subject matter of the following description and the drawings of certain exemplary embodiments.

DETAILED DESCRIPTION OF THE INVENTION

Figure 1:
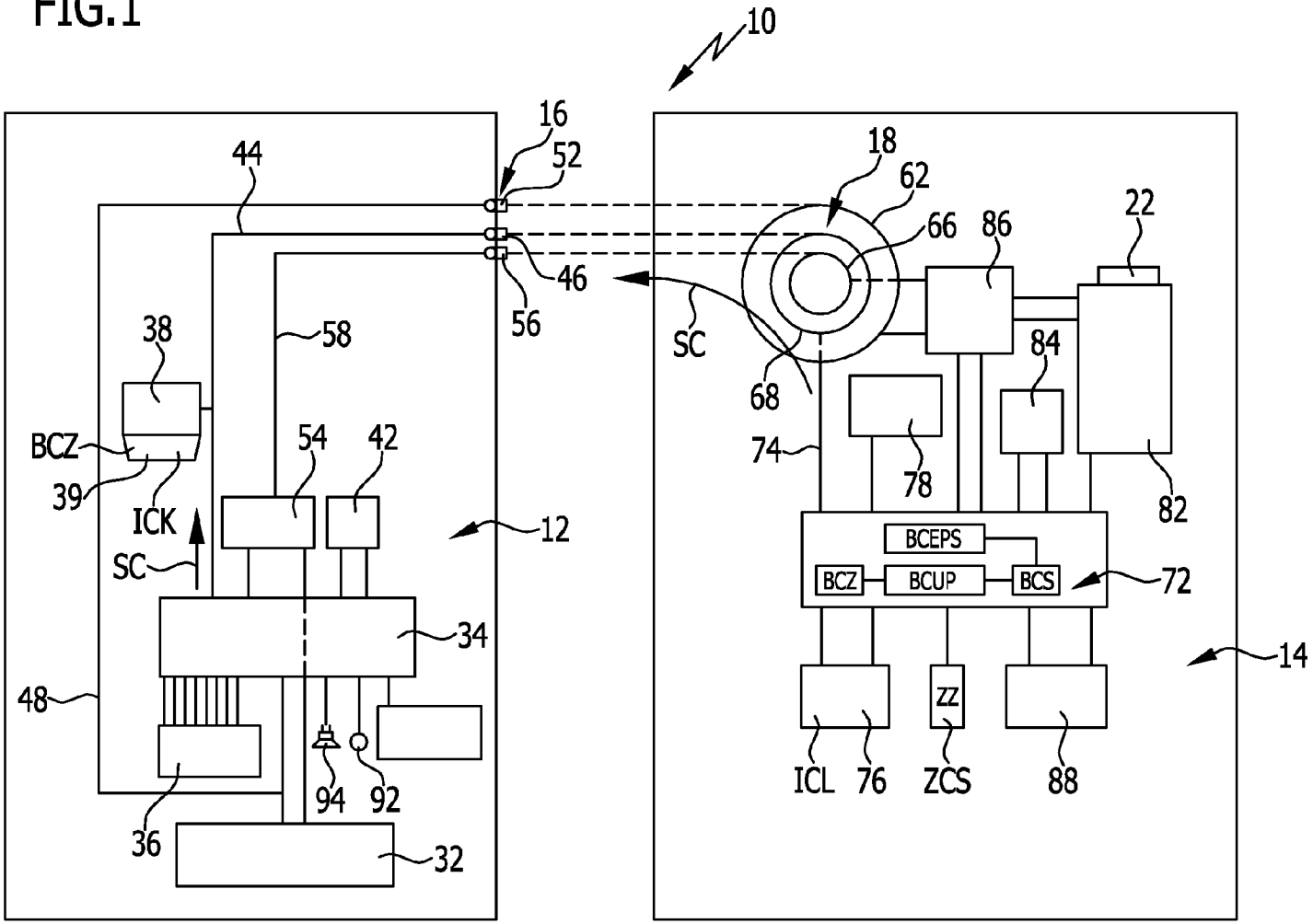
FIG. 1 is a schematic diagram of an electronic key and an electronic lock of a first exemplary embodiment of a locking system according to the invention.
Figure 2:
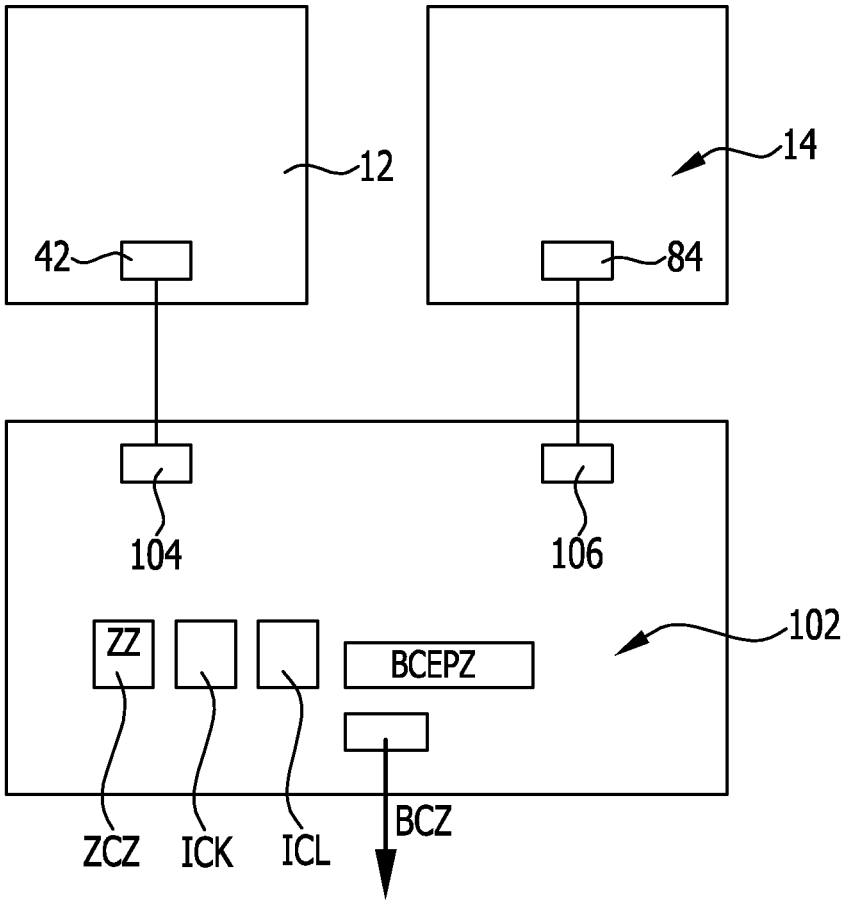
FIG. 2 is a schematic diagram of activation of the electronic key and electronic lock with a central unit of the electronic locking system.

A first exemplary embodiment shown in FIG. 1 of an electronic locking system 10 according to the invention, designated overall 10, comprises an electronic key 12 and an electronic lock 14.

The electronic key 12 here comprises a contact assembly 16, in particular comprising spring contacts, which can be brought into operative connection with a mating contact assembly 18, in particular comprising concentric contact rings, via a conductive connection by placing the contact assembly 16 onto the mating contact assembly 18.

Due to the electrical interaction between the electronic key 12 and the electronic lock 14, it is then possible, by means of the electronic key 12, to actuate a locking bolt 22, i.e. to move the latter for example from a locked position into an open position or when required also vice versa.

The electronic key 12 comprises for this purpose a voltage source 32, for example in the form of a battery, which supplies a processor 34 with current and voltage.

The processor 34 is capable of interacting with an input unit 36 and with a security processor 38, which is provided with a secured memory 39.

Not only are an identification code ICK and an assignment password of the key 12 stored in the secured memory 39, but an externally generated authorization code BCZ can also be saved therein by the processor 34.

The processor 34 is additionally provided with an interface 42 which serves to activate and/or configure the processor 34.

A data line 44 furthermore leads from the processor 34 to the memory 39 and onward to a data contact 46 of the contact assembly 16.

A ground line 48 leads directly from the voltage source 32 on the one hand to the processor 34 and on the other hand to a ground contact 52 of the contact assembly 16.

Via a switch unit 54, the processor 34 is capable of activating a supply line 58 leading from the voltage source 32 to a supply contact 56 of the contact assembly 16.

On interaction of the contact assembly 16 of the electronic key 12 with the mating contact assembly 18 of the electronic lock 14, the ground contact 52 comes into contact with a mating ground contact 62, in particular in the form of a contact ring, and the supply contact 56 comes into contact with a mating supply contact 66, in particular in the form of a contact ring. A processor 72 provided in the electronic lock 14 is thus activatable by the electronic key 12 and operable with the voltage source 32 of the electronic key 12 without the electronic lock 14 requiring an internal voltage source for this purpose.

Furthermore, the data contact 46 of the contact assembly 16 also comes into contact in this case with a mating data contact 68, in particular in the form of a contact ring, of the mating contact assembly 18, which is in turn connected via a data line 74 to the processor 72.

A memory 76 in the form of an EEPROM, which also accommodates an identification code ICL of the electronic lock 14 and an assignment password, a clock 78 and a locking drive 82 are also coupled with the processor 72.

The processor 72 can furthermore be activated and/or configured via an interface 84 coupled with this processor.

The processor 72 is in turn operated with the voltage of the voltage source 32; in the case of a locking drive 82 likewise to be operated via the voltage source 32, a voltage transformer 86 is preferably provided in the electronic lock 14, which transformer converts the voltage provided by voltage source 32 into a higher voltage for example for operating the locking drive.

A log memory 88, in which activities of the processor 72 of the electronic lock 14 are logged and saved, is additionally associated with the processor 72.

The locking system 10 according to the invention now operates as follows:

The externally generated authorization code BCZ is transferred to the electronic key 12 via the input unit 36 and saved by the processor 34 in the secured memory 39 of the security processor 38.

For this purpose, the processor 34 calculates a security code SC in the form of a hash code and transfers it with the authorization code BCZ to the security processor 38.

Moreover, the processor 34 activates the supply contact 56 via the switch unit 54, such that this supply contact is at the supply voltage of the voltage source 32.

If a connection is made between the contact assembly 16 of the electronic key 12 and the mating contact assembly 18 of the electronic lock 14, the processor 72 of the electronic lock 14 is powered up by a reset solely by the presence of the supply voltage at the mating supply contact 66 and the presence of ground at the mating ground contact 62 and then begins to communicate with the security processor 38 via the connection of the data line 74 to the data line 44.

However, before the content of the secured memory 39 of the security processor 38 is read out, it is checked whether the security processor 38 is per se authorized to exchange data with the processor 72, for example by checking whether the security processor 38 is listed in a list present in the memory 76.

A security code SC is then calculated in the form of a hash code by the processor 72 and, using the security code SC, the secured memory 39, which comprises the authorization code BCZ, is read out.

The memory 39 is here in particular read out without any activity of the processor 34 of the electronic key 12.

Once the authorization code BCZ has been read out, the processor 72 checks on the basis of an internal authorization code BCS determined with an internal authorization code determination program BCEPS and of an authorization code checking program BCUP, which compares the authorization code BCZ with the authorization code BCS with regard to their identical nature, that the authorization code BCZ is correct and, in the case of one of the authorization codes BCZ and BCS, provides opening of the electronic lock 14.

In the event of authorization code BCZ and BCS being identical, the processor 72 in the first exemplary embodiment activates the locking drive 82 and this moves the locking bolt 22 for example from the locking position thereof into the open position thereof, such that the electronic lock 14 then releases access for example to a secured unit.

At the same time, the processor 72 reads out the clock 78 to create a log which records access to the lock 14, reading out of the access data record ZD from the memory 38 and activation of the locking drive 82, wherein this log is then saved in the log memory 88.

All the statuses of the electronic lock 14 which are to be determined by the processor 72 and displayed to the user are preferably not displayed by the electronic lock 14, but instead transferred via the data line 74 and the data line 44 to the processor 34 of the electronic key 12, which then in turn activates one or more optical display units 92, 94, such as for example LED lamps or display devices or acoustic signal generators, such as for example buzzers, or generates sequences of notes which are transmitted by a loudspeaker.

In order to obtain the intended function of the electronic key 12 and the electronic lock 14, both the electronic key 12 and the electronic lock 14 must be activated by a central unit 102 via a wired connection, which central unit is in turn able to access the interface 42 of the electronic key 12 via an interface 104 and the interface 84 of the electronic lock 14 via an interface 106 simultaneously or also in succession or in each case separately, in order to activate both the electronic key 12 and the electronic lock 14, wherein in particular assignment passwords and/or the respective identification code ICK and the respective identification code ICL and cycle statuses ZZ of the cycle counters ZCZ and ZCS are matched or exchanged between the central unit 102 and the electronic key 12 and the electronic lock 14, i.e. either transferred or read out.

After such activation of the electronic key 12 and the electronic lock 14, the respective connections between the interfaces 42 and 104 and 84 and 106 can be broken and the central unit 102 is capable, by means of an authorization code determination program BCEPZ present in the central unit 102, of determining the respective one-off external authorization code BCZ by means of a hash algorithm, which latter authorization code can then be input, for example by the user, via the input unit 36 into the electronic key 12, whereupon the processor 34 of the electronic key 12 is then capable of saving the authorization code BCZ in the secured memory 39.

After interaction with the electronic key 12, the electronic lock 14 is furthermore then capable (as described) of reading out the external authorization code and, using the authorization code determination program BCEPS together with the identification code ICK, the identification code ICS and the cycle status ZZ of the internal cycle counter ZCS, of determining the internal authorization code BCS by means of the same hash algorithm as in the central unit 102, and checking whether the latter authorization code is identical to the external authorization code BCZ and permitting opening of the locking bolt 22.

Figure 3:
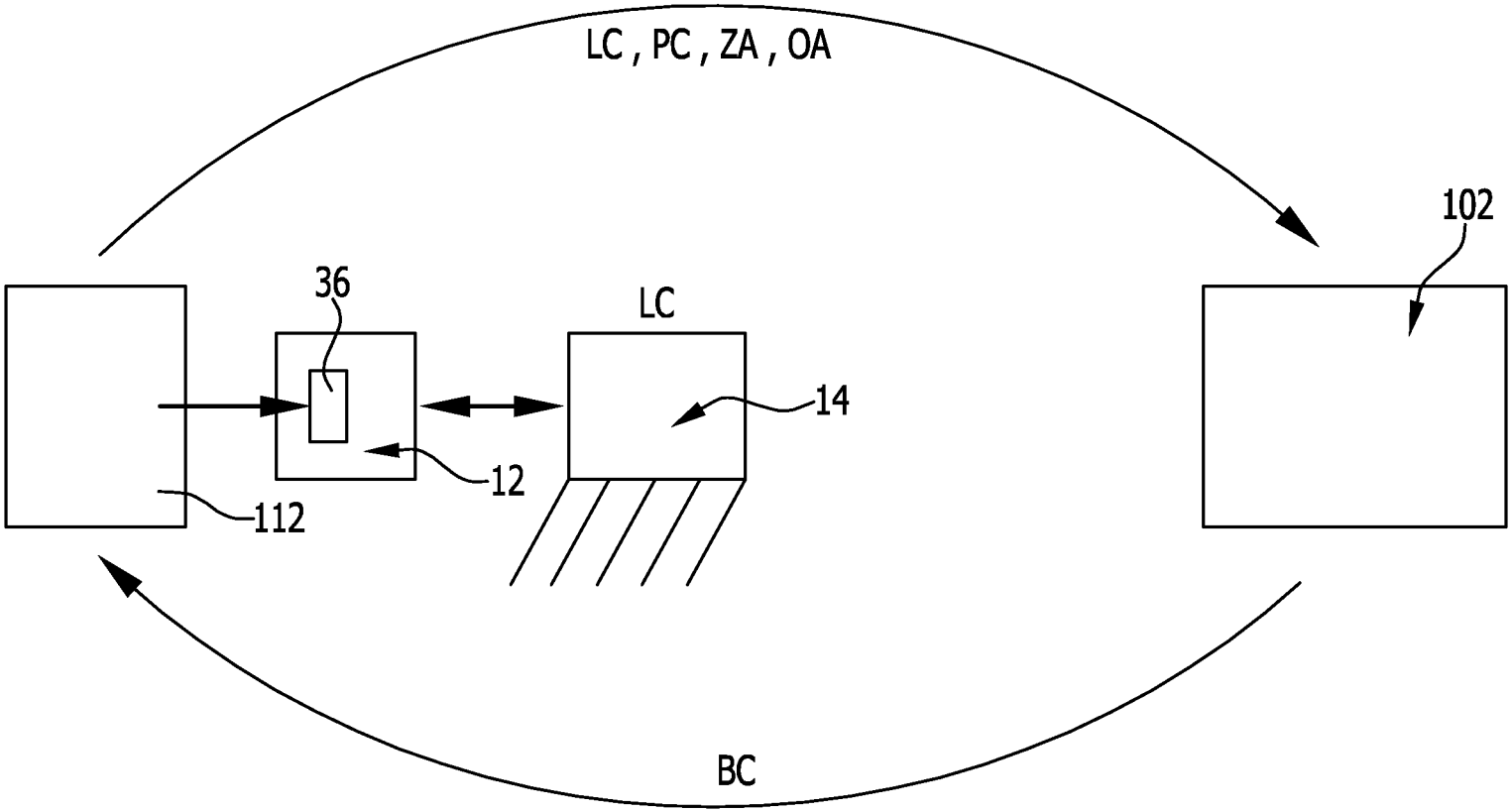
FIG. 3 is a schematic diagram of one possibility for generating and transferring an external authorization code.
Figure 4:
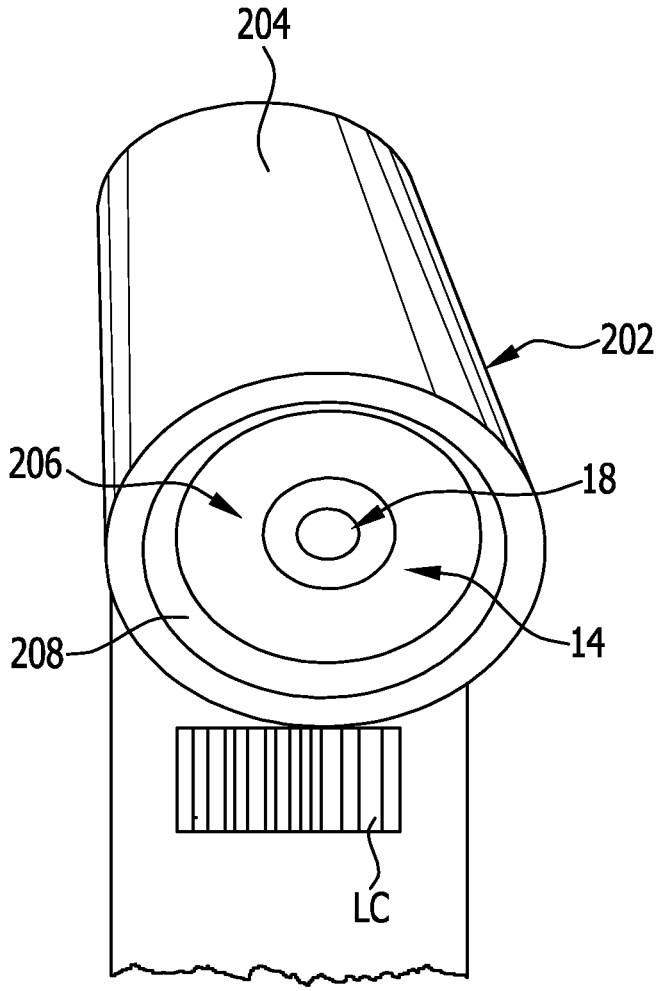
FIG. 4 is a perspective front view of a first exemplary embodiment of a tubular safe without an electronic key positioned thereon.

As shown in FIG. 3, a locking device 10 according to the invention can be used in the field for example in such a way that an operator can, in the case of a lock 14 arranged stationarily in the field, bring about opening of the lock 14 with an electronic key 12 by the following procedure.

An operator wishing to open a lock 14 arranged stationarily in the field, requests the transfer of an external authorization code BCZ from the central unit 102, for example via a mobile communication unit 112, in particular a portable mobile radio device or another communication device.

The central unit 102 can for this purpose check a plurality of details or request a plurality of details which must be available before the authorization code BCZ is obtained.

Such data are for example a local code LC of the lock 14 and/or a personal code PC of the operator and/or time details ZA at the operator's location and/or location details OA of the operator.

All these items of information can be checked by the central unit 102. In the event that checking of all these items of information and details is positive, the central unit 102 generates an external authorization code BCZ, since the central unit 102 can draw conclusions from the local code LC and/or the personal code PC and/or the time details and/or the location details OA regarding the identification codes ICK and ICL and therefore, using the identification code ICK, known to the central unit, of the electronic key 12 to be used for opening and the identification code ICL of the electronic lock 14 to be opened and the cycle status ZZ of the cycle counter ZCZ, uses the authorization code determination program BCEPZ to generate the external authorization code BCZ by means of a hash algorithm, which latter authorization code is transferred to the operator, for example acoustically or as a message or as a data record, for example via the mobile communication unit 112.

The authorization code BCZ is then transferred by the operator or by the mobile communication unit 112 via the input unit 36 to the electronic key 12.

The authorization code BCZ is in particular only an authorization code BCZ which authorizes one-off opening of the electronic lock 14.

The electronic key 12 then saves this authorization code BCZ in the memory 39 by means of a processor 34.

If the contact assembly 16 is then connected with the mating contact assembly 18, the processor 72 of the electronic lock 14 is activated (as already described) and (as already described) reads out the authorization code BCZ from the electronic key 12.

By internal calculation of an authorization code BCS by means of its authorization code determination program BCEPS using the identification code ICK of the electronic key 12 read out from the secured memory 39, the identification code ICK of the electronic lock 14 saved in the memory 76 and the cycle status ZZ of the cycle counter ZCS of the electronic lock 14 and by checking that the authorization code BCZ is identical to the authorization code BCS by means of its authorization code checking program BCUP, the processor 72 is capable of determining whether the external authorization code BCZ is authorized for subsequent opening of the locking bolt 22 and (if this is the case in the event of the authorization codes being identical) the locking drive 82 is activated for actuation of the locking bolt 22.

After the one-off opening of the electronic lock 14, the authorization code BCZ for one-off opening of the electronic lock 14 is used up and can no longer be used for opening this lock.

Even if the access data record ZD were to remain stored in the electronic key 12, renewed activation of the processor 72 of the electronic lock 14 and checking of the authorization code BCZ would reveal that this code was not authorized for re-opening of the electronic lock 14.

In the central unit 102, checking of the items of information transferred via the mobile communication unit 12 with regard to the local code and/or personal code and/or time details and/or location details can be carried out by a person who for example supervises the operator's activities in the field and is capable of evaluating whether these items of information are consistent.

This checking can, however, also be carried out by the central unit 102 under software control.

The authorization code BCZ is, however, determined in the central unit 102 by the authorization code determination program BCEPZ, which makes reference to all or only some of these items of information for determining the authorization code BCZ.

The advantage of the locking system according to the invention can here in particular be considered to be that the electronic lock 14 itself does not require a voltage source, but may be left unused for as long as desired since the entire power supply for activating the processor 72 of the electronic lock and for operating the processor 72 of the electronic lock is provided via the voltage source 32 of the electronic key which is carried by the operator and can therefore always be recharged or replaced by the operator.

Furthermore, due to the activation of the electronic key 12 and the associated electronic lock 14 by the central unit 102, there is an unambiguous correlation between the electronic key 12 and the electronic lock 14 and the central unit 102 and thus an unambiguous correlation between the electronic key 12 intended for opening a specific electronic lock 14 and the likewise correspondingly correlated central unit 102, which applies this correlation of electronic key 12, electronic lock 14 and central unit 102 when calculating the authorization code BCZ. Accordingly, on activation of one or more electronic keys 12 and one or more electronic locks 14 intended for this electrical key 12 by exchange of passwords, exchange or checking of the identification codes ICK and ICS and matching of the cycle counters, initial conditions can be established for the authorization code determination programs BCEPS and BCEPK to be able mutually independently to determine identical authorization codes BCZ and BCS.

Such an electronic locking device can for example be used in a tubular safe designated overall 202 which has a locally fixedly installed tubular body 204 into which a tubular body lid 206 comprising the electronic lock 14 can be inserted and locked to the tubular body 204.

The tubular body lid 206 here bears on the external front side 208 thereof the mating contact unit 18 of the electronic lock 14 with the contact rings 62, 66, 68.

The tubular body 204 is furthermore provided with the local code LC which permits identification of the specific tubular safe 202 at the respective specific location.

Figure 5:
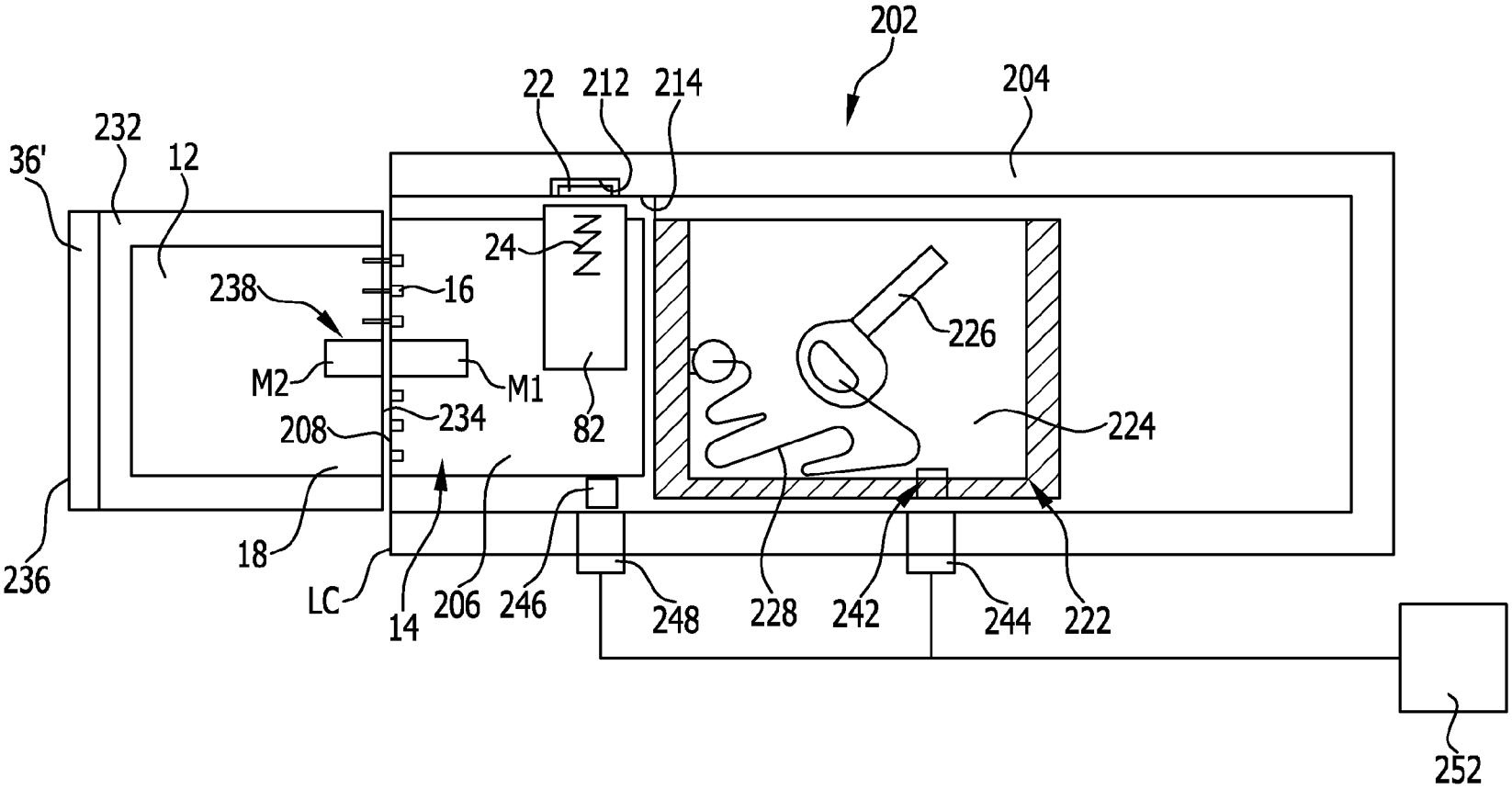
FIG. 5 is a section through the tubular safe alone line 5-5 in FIG. 4 with electronic key positioned thereon.

As shown in FIG. 5, the tubular body lid serves as a housing for accommodating the electronic lock 14, wherein the locking drive 82 and the locking bolt 22 are also arranged in the tubular body lid 206, such that the locking bolt 22 can engage for example in a locking bolt receptacle 212 on an inner side 214 of the tubular body 204 in order to fix the tubular body lid 206 in its locking position shown in FIG. 5.

Since such tubular safes 202 frequently serve to provide secure storage for access keys, a key container 222 is also retained, for example fixedly mounted or detachably held, on the tubular body lid 206, which container has an accommodation space 224 for a key 226, wherein the key 226 is for example also additionally secured in the accommodation space 224 by a retaining strap 228, such that while the key 226 can indeed be removed from the accommodation space 224, it cannot be separated from the key container 222.

Such a key container 222 has the major advantage that it offers the possibility of arranging the key 226 on the tubular body lid 206 in such a manner that it can be introduced with the tubular body lid 206 into the tubular body 204 simply and without the key being able to jam in the tubular body 204 or between the tubular body 204 and the tubular body lid 206 and can be reliably fixed by locking the tubular body lid 206.

A key container 222 furthermore also offers the possibility, for example when the tubular body 206 is installed in a damp environment, of storing the key 226 dry and/or unsoiled in the tubular body 204, such that for example any dirt entering the tubular body 204 can be kept away from the key 226 during storage thereof.

Figure 6:
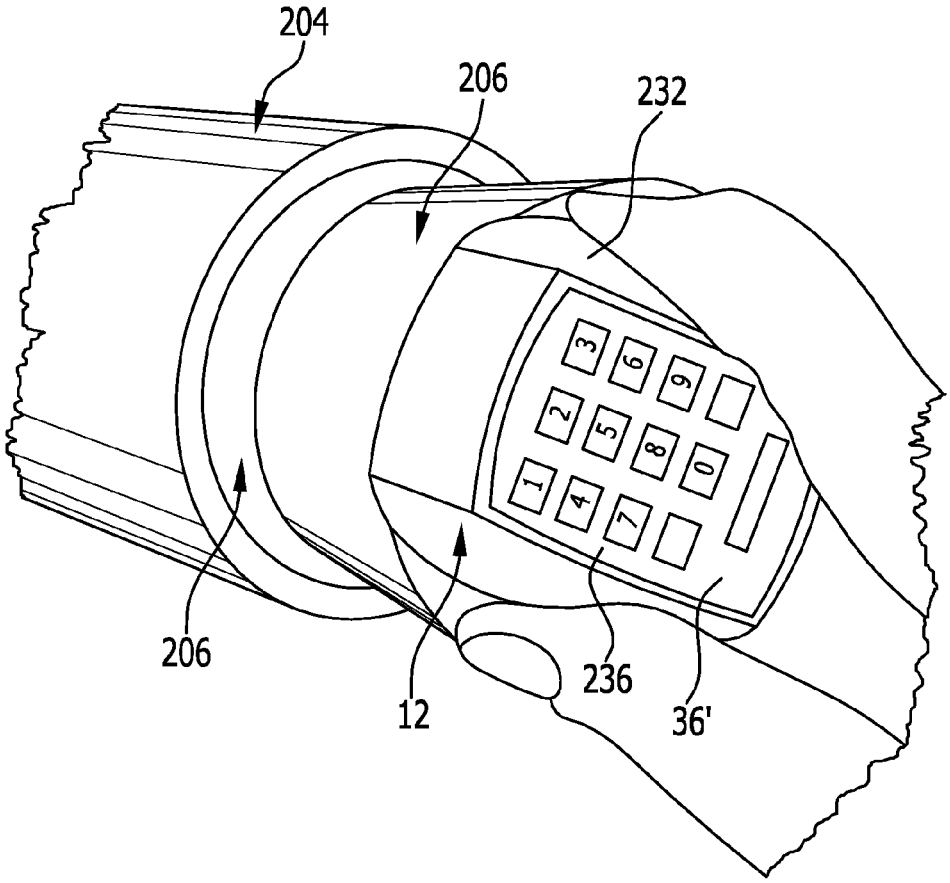
FIG. 6 is a perspective view of the tubular safe according to FIG. 4 on opening thereof.

As shown in FIG. 5 and FIG. 6, the electronic key 12 according to the invention is arranged in a housing 232 which has a reverse side 234 positionable on the front side 208 of the tubular body lid 206, which reverse side has the contact assembly 16 for contacting the mating contact assembly 18 on the front side 208 of the tubular body lid 206 and, on the front side 236 thereof opposite the reverse side 234, bears the input unit 36' which, in this case, takes the form of a keypad or touch panel and serves for inputting the authorization code BCZ.

A magnetic connection 238 is provided for detachably fixing the housing 232 of the electronic key 12 to the tubular body lid 206, which magnetic connection comprises either two magnets M1 and M2 or a magnet M1 and an element magnetizable thereby.

The magnetic connection here serves not only to fix the electronic key 12 detachably to the electronic lock, but also to align the contact assembly 16 centrally relative to the mating contact assembly 18.

This magnetic coupling between the housing 232 and the tubular body lid 206 makes it possible, when the electronic lock 14 is unlocked, to remove the tubular body lid 206, which constitutes the housing for the electronic lock 14, with the housing 232 of the electronic key 12 from the tubular body 206 by withdrawing the tubular body lid 206 from the tubular body 204.

In order furthermore to permit a local display to the effect that the tubular body lid 206 is reliably located in the tubular body 204, it is for example possible to provide a magnet 242 on the key container 222, to detect the position of the magnet within the tubular body by a magnetic field sensor 244 which is arranged on the tubular body, with regard to the position of the magnet in the tubular body 204, and so to ascertain whether the key container 222 and preferably then also the tubular body lid 206 are arranged in a position in the tubular body 204 in which the tubular body lid 206 is locked by the locking bolt 22 loaded for example by a resilient energy storage mechanism 24.

If the position of the tubular body lid 206 is likewise to be acquired in this respect, it is also possible to arrange a magnet 246 in the tubular body lid 206 and to acquire the position thereof by a magnetic field sensor 248 likewise arranged on the tubular body 204, such that it is possible to detect both the correct position of the key container 222 and the correct position of tubular body lid 206 in the locking position thereof and transfer this for example by a transfer unit 252 either wirelessly or by wired connection to a security center or also the central unit 102.

Figure 7:
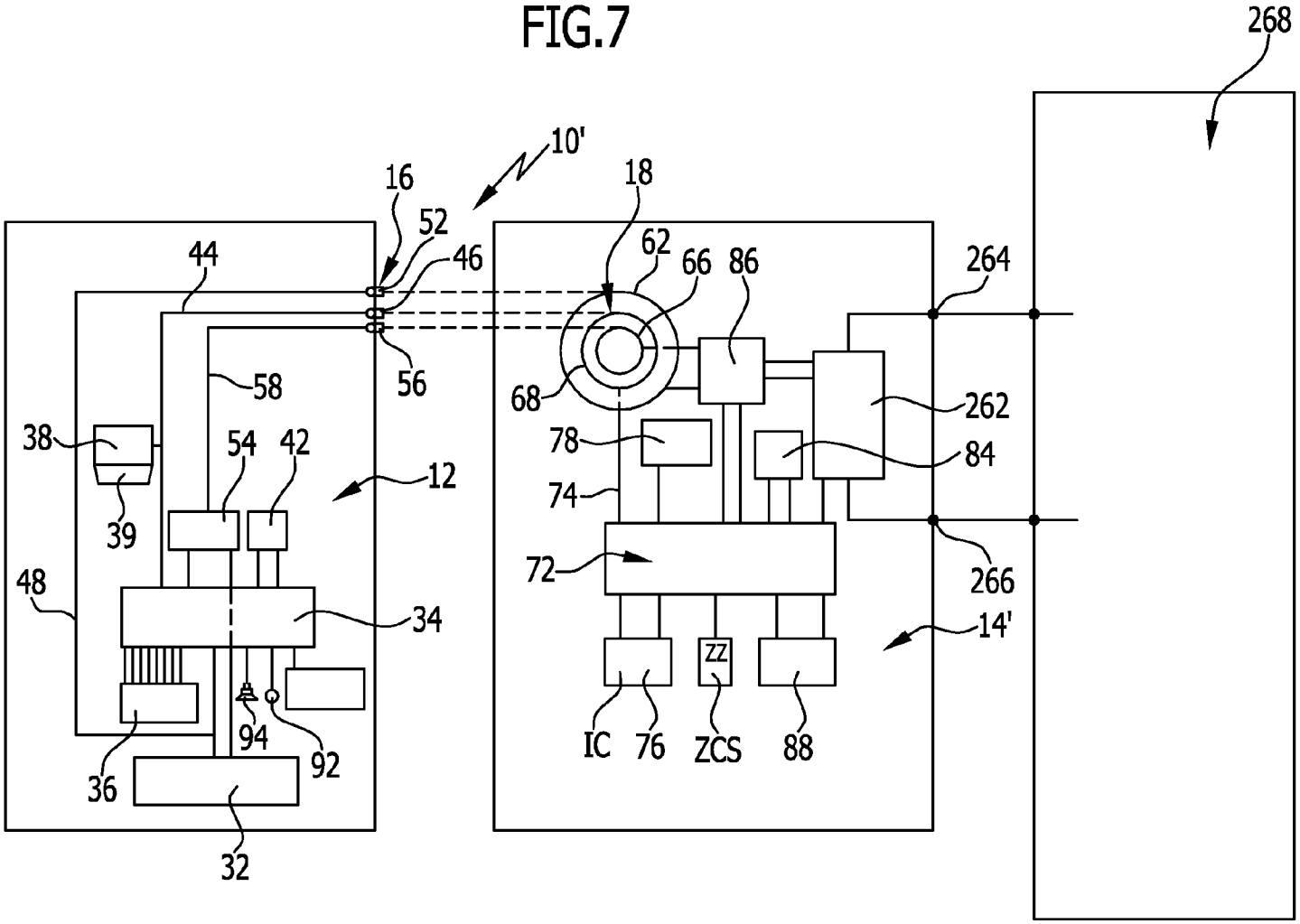
FIG. 7 is a schematic diagram similar to FIG. 1 of a second exemplary embodiment of a locking system according to the invention.

In a second exemplary embodiment of a locking device 10 according to the invention, shown in FIG. 7, all those parts which are identical to those of the first exemplary embodiment are provided with the same reference signs such that, with regard to the description thereof, reference can be made to the full content of the first exemplary embodiment.

In contrast to the first exemplary embodiment, however, the electronic lock 14' is not provided with a locking drive 82, but instead with a switch unit 262 which is capable of establishing or interrupting a connection between external terminal connections 264 and 266 of the electronic lock 14', such that it is possible via the external terminal connections 264 and 266 to activate or immobilize an existing locking system 268.

The external terminal connections 266 and 264 can for example serve to interrupt a current supply to the pre-existing locking system 268 and so disable it or to establish the current supply thereto and thus activate the pre-existing locking system 268.

The existing locking system 268 can here be a locking system of any desired structure which is for example already present and fully installed in a building, such that the locking device 10' according to the invention merely serves to disable completely or to activate this locking system 268.

A pre-existing locking system 268 which has a low level of security can thus be secured with the locking system 10' according to the invention which has a very high level of security, without having to completely uninstall the existing locking system 268 and install a new locking system.

Figure 8:
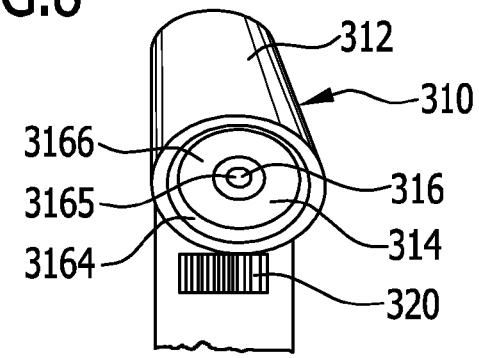
FIG. 8 is a further exemplary embodiment of a tubular safe with an electronic lock integrated in a locking lid and a code which characterizes the electronic lock.

A locking device 310 shown in FIG. 8 is formed by a tubular safe 312 which is arranged in theft- and burglar-proof manner in a wall of a building or on a robust support in the vicinity of the building. The tubular safe 312 is closed at the front side thereof by means of a locking lid 314. An electronic lock 316, as is shown and described in detail in WO 2012/045474 A1, the disclosure content of which is hereby included in the subject matter of the present application, is integrated into the locking lid 314.

Figure 12:
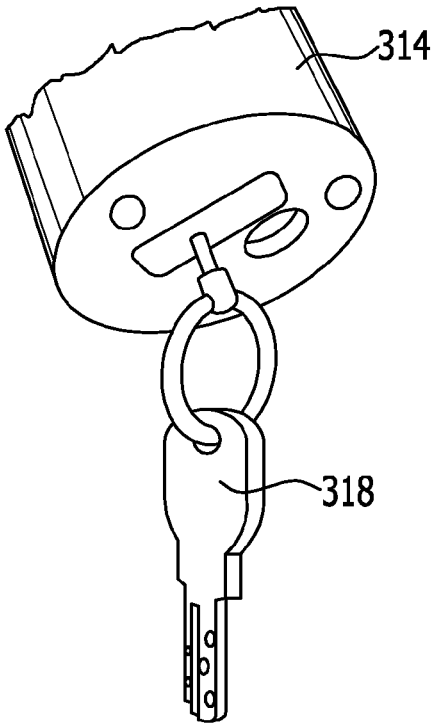
FIG. 12 shows the arrangement of a physical key on the inner side of the tubular safe locking lid.

On the inner side of the locking lid 314, there is arranged a physical key 318 (as shown in FIG. 12), with which it is possible to open at least one access to the building (not shown) and optionally further doors in this building.

On the locking device 310 locked by means of the electronic lock 316, which for example corresponds to that of the first exemplary embodiment, there is arranged a code 320 which characterizes the electronic lock 316. In the exemplary embodiment shown, this code takes the form of a barcode 320, but can also be formed by an Aztec code or an invisible magnetic code. In the simplest case, the code 320 can be manually read out by a user 320. According to an advantageous development, a communication device 324 carried by the user 322 has a sensor or a reader for automatically acquiring the code 320. The communication device 324 can for example be formed by a smartphone, the camera of which, in conjunction with stored application software (an "app"), serves to read in a barcode or alternatively an Aztec code which are used in the exemplary embodiment as the code 320 which characterizes the electronic lock 316. As already mentioned, codes 320 which are invisible, magnetic or transferred via a radio signal may be emitted by the electronic lock 316 or a facility arranged in the vicinity thereof and received or read out by the communication device 324.

Figure 10:
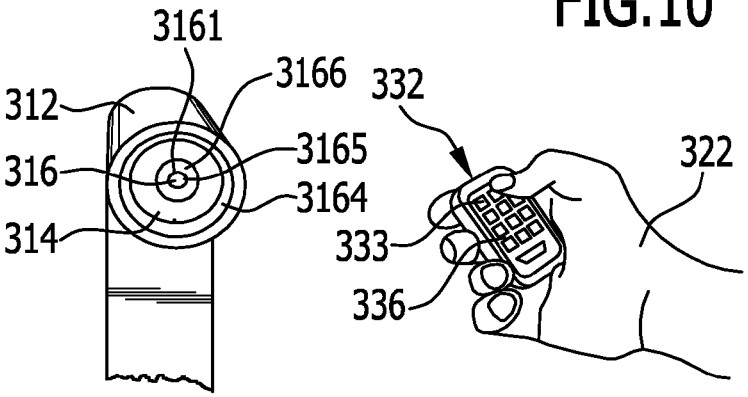
FIG. 10 shows the hand of a user during input of the authorization code into an electronic key.
Figure 11:
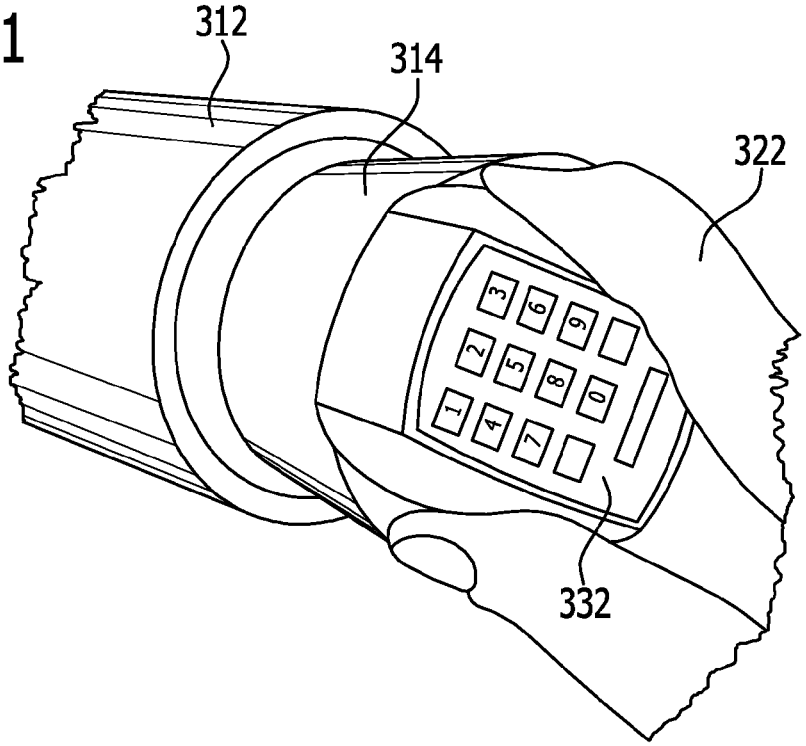
FIG. 11 shows the use of the electronic key as a handle on opening the electronic lock.

The electronic lock 316 is openable by means of an electronic key 332, provided that an authorization code 336 appropriate to the electronic lock 316 is input into this electronic key 332. FIG. 10 shows how the authorization code 336 is input by the user 322 via a keypad arranged on the electronic key 332. The electronic key 332 can then, as shown in FIG. 11, be positioned on the electronic lock 316 and be used directly as a handle for opening the locking lid 314.

Figure 9:
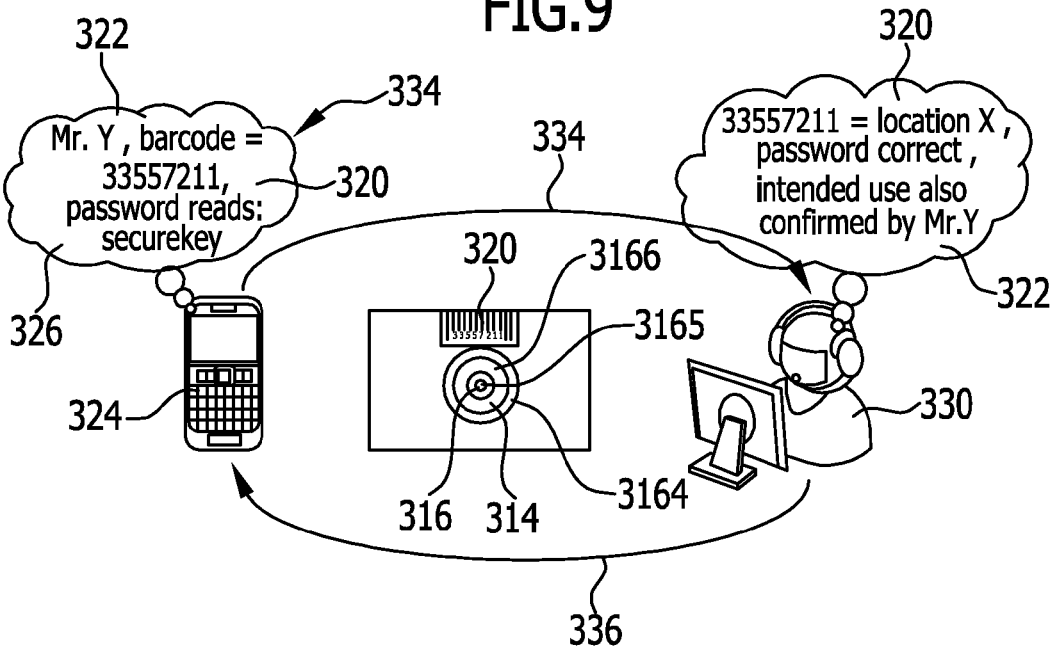
FIG. 9 is a sequence diagram which clarifies the transfer of the code between a user and a central information processing facility.
Figure 13:
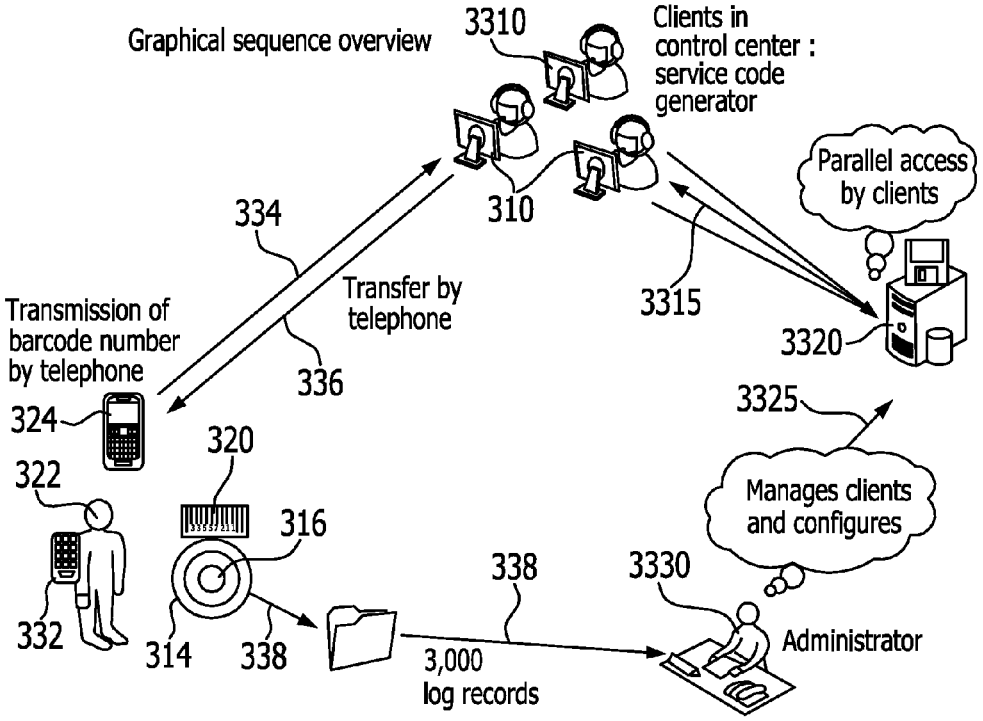
FIG. 13 is a sequence diagram which clarifies communication between the user, a client computer, a server, an administrator and the electronic lock.
Figure 14:
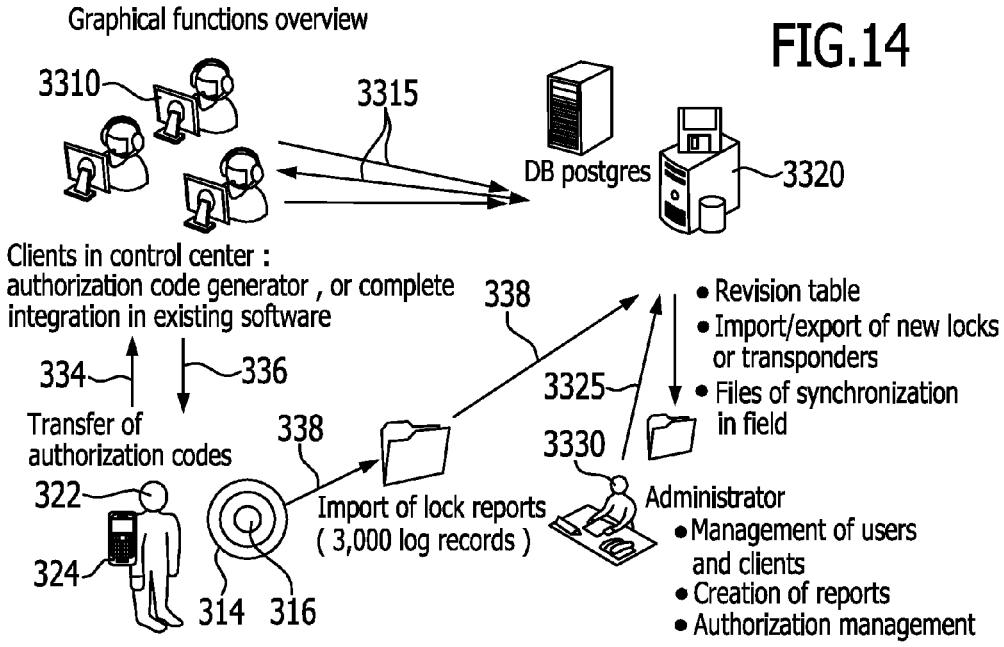
FIG. 14 is a diagram which clarifies the functions from the standpoint of the user, the client computer, the server and the administrator.

According to the invention, however, this process is preceded by the procedure shown in FIGS. 9, 13 and 14, in which the user 322 transfers the item of information which characterizes the electronic lock 316 (the code 320) and an item of information which characterizes this user in the form of a code 326 (for example in the form of a personal password or a letter/number combination) by means of the communication device 324 to a central information processing facility 330 (for example a security service control room). The item of information 320 which characterizes the electronic lock 316 and the item of information 326 which characterizes the user 322 together form a query data record 334 which, in the simplest case, is transferred manually via a telephone call to the central information processing facility 330.

According to an advantageous development of the invention, the query data record 334 is transferred automatically, for example as a character string in a short message (SMS) sent by the communication device 324.

In the information processing facility 330, the query data record 334 with the codes 320 and 326 contained therein is checked, preferably with additional matching with a time parameter 328 (for example the duty roster or planned route of the user 322). If this checking leads to a positive result, the information processing facility 330 generates an authorization code 336, as was described in the first exemplary embodiment of the locking system, and sends this code to the communication device 324. In the simplest case, this may again proceed by means of a telephone call.

According to an advantageous further development, the authorization code 336 is transferred to the communication device 324 automatically, for example in the form of a character string embedded in a short message (SMS).

The authorization code 336 is either transferred by the user 322, as already mentioned in connection with FIG. 10, manually via an input device, in particular a keypad, to the electronic key 332 or the authorization code 336 is transferred automatically by the communication device 324 to the electronic key 332. This transfer may be achieved by the communication device 324 having a transmitter and the electronic key 332 having a receiver which communicates with this transmitter. The transfer can be made, for example, via an infrared signal, via Bluetooth or another suitable short-range transmission protocol.

According to a further development of the invention, the communication device 324 and the electronic key 332 can also form a structural unit which has a sensor for acquiring the code 320, an input device for the code 326, a transmitter for transferring the query data record 334 to the central information processing facility 330, a receiver for receiving the authorization code 336 and a memory for storing the authorization code 336 in the electronic key 232. The structural unit also contains software for acquiring the codes 320 and 326, for automatic transfer of the query data record 334, for automatic reception and for storing the authorization code 336.

The central information processing facility 330 advantageously has at least one client computer 310 and at least one server 3320. The client computer 3310 serves to receive the query data record 34 and to transfer this data record to the server 3320. The data traffic between the client computer 3310 and the server 3320 is denoted 3315 in the Figures.

The server 3320 additionally stores time parameters 328 which for example depict a planned route of the user 322 with a time, preferably with an appropriate time buffer (earliest opening time, latest opening time, latest closing time), which characterizes the opening of the electronic lock 316 in question. All the data in the server 3320 are managed by an administrator 3330. The data traffic between the server 3320 and the administrator 3330 is denoted 3325 in the Figures.

A signal which is automatically transmitted by a transmitter installed on the electronic lock 316 on opening and locking of the electronic lock 316 can also be transferred to the server 3320.

In a further developed embodiment, at variance with the representation in FIGS. 9, 13 and 14, the method and locking system can also function fully automatically without human interaction. Reception of a query data record 334 by the client computer 3310, transfer of the query data record 334 to the server 3320, checking of the characterizing items of information (codes 320 and 326) contained in the query data record 334, matching with the at least one time parameter 328, generation of an authorization code 336 and transfer of the authorization code 336 to the communication device 324, optionally again with interposition of a client computer 3310 can preferably proceed fully automatically under software control.

It has already been described in connection with the possible embodiments of the communication device 324 and the electronic key 332 that the method and system according to the invention for secured approval of an access authorization or for secured key transfer can proceed fully automatically even from the standpoint of the user 322.

According to the invention, the electronic key 332 is provided with an input device 333, by means of which the user 322 can input the authorization code 336, transferred by the central information processing facility 330 to the communication device 324, into the electronic key. Such an electronic key 332 provided with an input device 333 is generally also usable instead of the stationary input devices which are today already in widespread use, in which the input of a code by an authorized user can relatively easily be observed by an unauthorized observer and which consequently represents a considerable security risk. In contrast, a code can be input completely unobserved and at some distance from the electronic lock 316 into a mobile electronic key 332, which is only subsequently used for opening an electronic lock.

As in the exemplary embodiment shown, a key 332 placed onto the electronic lock 316 and preferably temporarily connected by magnetic force to the electronic lock 316 can be used as the electronic key 332. The magnetic forces are provided by a magnet 3329 in the central region of the electronic key 332 and by a counter-magnet 3161 in the central region of the electronic lock 316, which magnets preferably take the form of permanent ring magnets and ensure automatic centering of the electronic key 332 with the electronic lock 316 and alignment of the contacts 3324, 3325 and 3326 with the concentrically arranged mating contact faces 3164, 3165, 3166 on the electronic lock 316 irrespective of their relative angle to one another.

It is, however, likewise possible to use electronic keys 332, for example in the form of a transponder, which interact contactlessly over a certain distance with the electronic lock 316.

Figure 16:
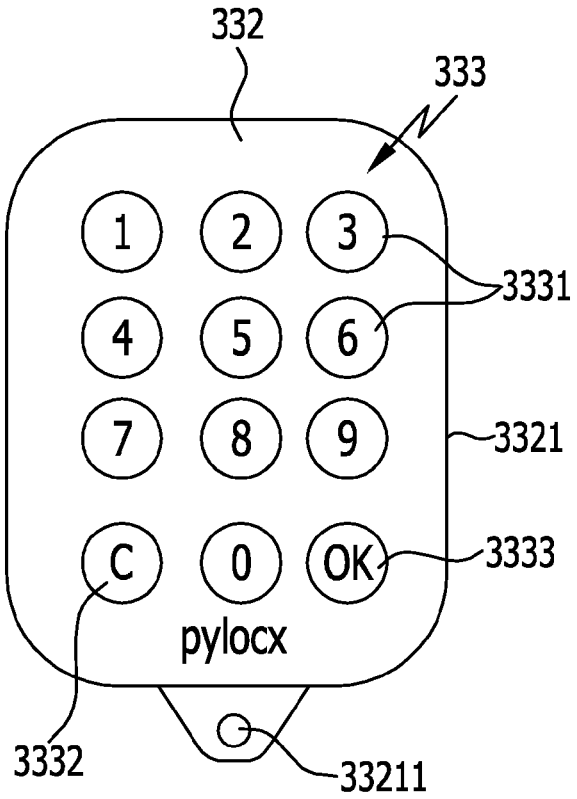
FIG. 16 is a schematic front view of an electronic key.

The electronic key 332 has a housing 3321, on the front side of which according to FIGS. 10 and 16 is arranged the input device 333. In the exemplary embodiment shown, this is a numerical keypad with 10 number keys 3331, a clear key 3332 ("C") and an input key 3333 ("OK"). Three contacts 3324, 3325 and 3326 resiliently mounted in the housing project out on the reverse side of the housing 3321, the centrally arranged contact 3325 thereof for example passing the positive voltage, the furthest outwardly located contact 3324 representing the ground connection and the contact 3326 serving for serial data transfer.

Figure 17:
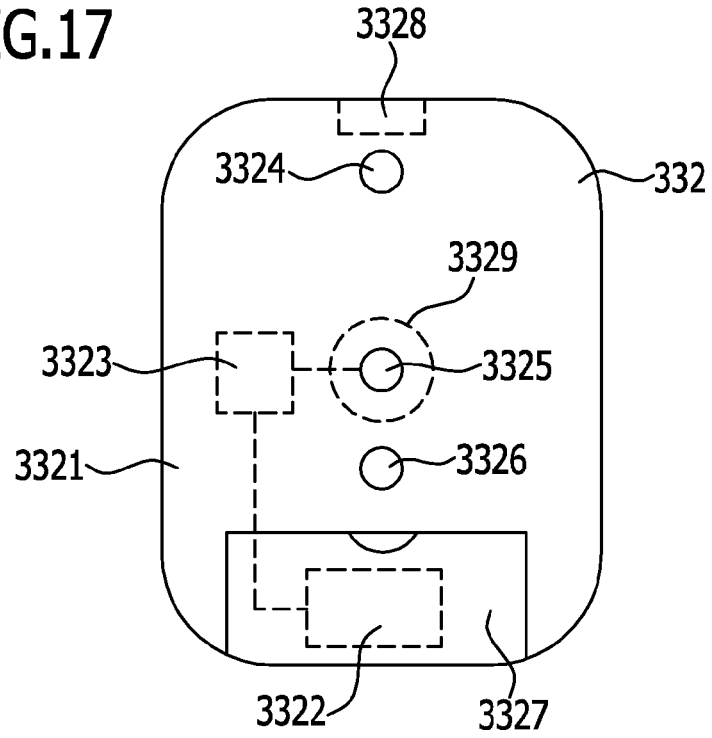
FIG. 17 is a schematic view of the reverse side of an electronic key.

The rear view of the electronic key 332 according to FIG. 17 also shows the lid of a battery compartment 3327 behind which a storage battery 3332 is arranged. This takes the form, for example, of a lithium-ion storage battery with an output voltage.

The electronic key 332 is furthermore provided with at least one interface 328, which in the present case is for example formed by a micro-USB interface and serves for programming the electronic key 332 and optionally also for charging the storage battery 3322.

The electronic key 332 interacts either with the electronic lock 316 shown in FIGS. 8 to 13 for example on a tubular safe 312 or on a protected space or another facility for which access authorization is required. The term "facility" should here be interpreted very broadly. An electronic lock 316 can protect not only machines, vehicles or the like, but also safe-deposit boxes, deposit boxes for valuables, safes or doors to security areas.

Figure 15:
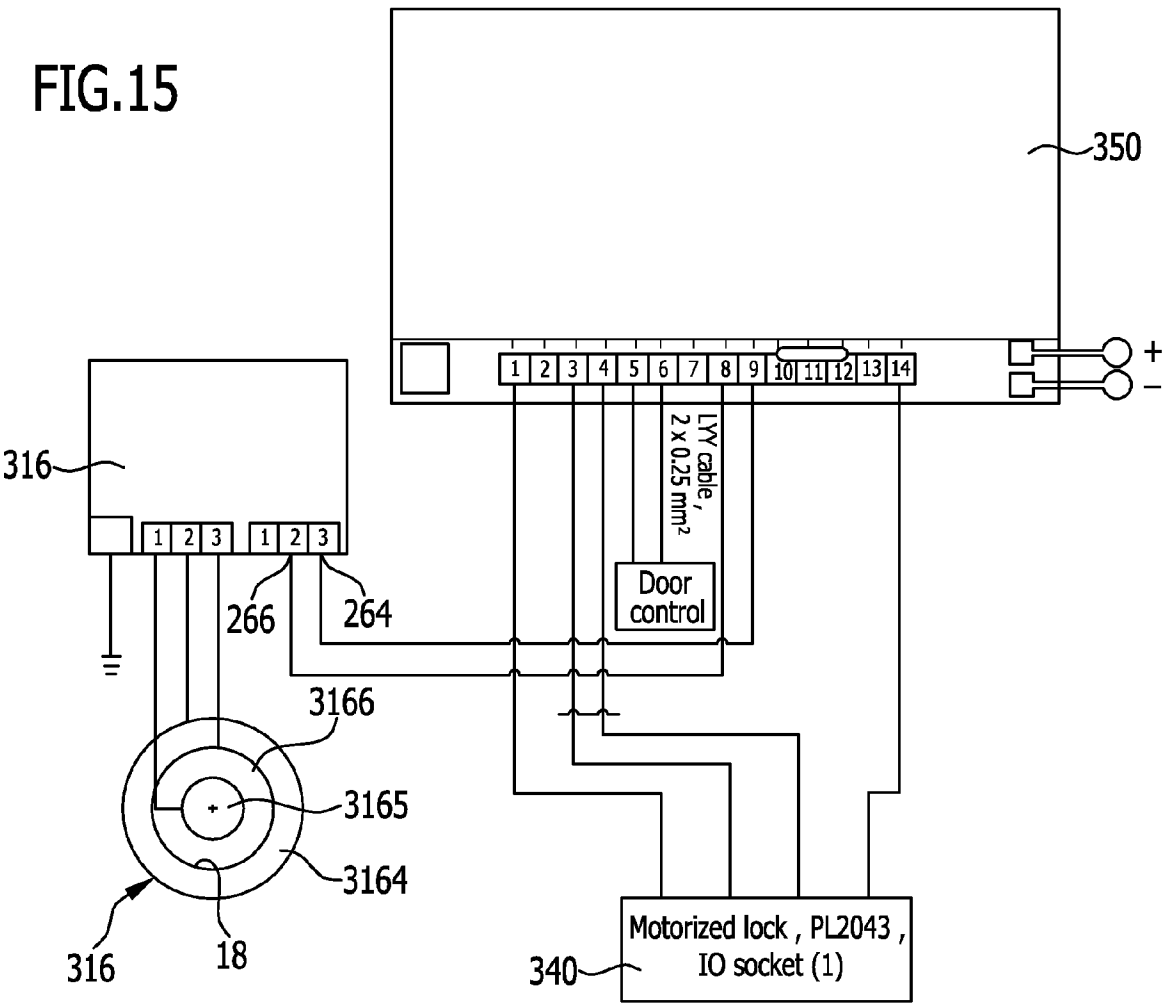
FIG. 15 is a schematic circuit diagram for an application of an electronic lock in cooperation with a control device and a motorized lock.

The example according to FIG. 15 shows that the protected facility can be released by the electronic lock 316 not only directly but also indirectly. In this latter case, the electronic lock 316 comprises a 220 V protective module for a protected facility (not shown) which is ultimately not released until a motorized lock 340 is actuated.

In this case, between the electronic lock 316, which for example corresponds to that of the second exemplary embodiment according to FIG. 7, and the motorized lock 340 a control device 50 is additionally arranged which can be powered by means of an internal power supply, but is not activated until the electronic lock 316 is actuated. Once a valid authorization code 336 has been transferred by the electronic key 332, not shown in FIG. 15, via the mating contact 3166 responsible for data transfer, the external power supply on the control device 350 is activated and the motorized lock 350 actuated. A more detailed description of the control device 50 follows at the end of the description.

The advantage of indirect actuation is that, while the protected facility is not in use, no operating voltage need be applied to it. It can be initialized at any time as required by the electronic key 332 via the electronic lock 316.

The invention claimed is:

1. A method for operating a locking system comprising an electronic key and an electronic lock and a central unit which in locking operation is used locally separately from the electronic key and the electronic lock, the method generates an external authorization code by the central unit by means of an authorization code determination program, the external authorization code is transferred to the electronic key and the external authorization code is saved in a memory by the electronic key, on interaction of the electronic key with the electronic lock, the external authorization code is read out from the memory by the electronic lock and is checked by a processor of the electronic lock in that, using an internal authorization code determination program, the processor itself determines an internal authorization code and compares it with the external authorization code received by the electronic key and, in the event of the determined internal authorization code being identical to the transferred external authorization code, the processor permits an opening process; wherein, prior to installation of the electronic lock at its intended location, the electronic lock is activated by the central unit, wherein in so doing the central unit matches the electronic lock identification code and the electronic lock cycle counter status with the identification code saved in the central unit and the stored cycle counter status.

2. A method according to claim 1, wherein the authorization code determination program of the central unit determines the external authorization code in such manner that only one-off opening is permitted therewith.

3. A method according to claim 2, wherein the authorization code determination program of the central unit determines the authorization code inter alia by taking account of a cycle counter.

4. A method according to claim 3, wherein the authorization code determination program of the electronic lock likewise determines the internal authorization code by taking account of a cycle counter.

5. A method according to claim 1, wherein the authorization code determination programs of the central unit and of the electronic lock determine the respective authorization code by taking account of the identification code of the electronic key and of the identification code of the electronic lock.

6. A method according to claim 1, wherein the authorization codes are determined by the authorization code determination programs by means of a hash algorithm.

7. A method according to claim 1, wherein the identification code of the electronic lock is stored in a secured memory.

8. A method according to claim 1, wherein, on activation of the electronic lock, the central unit matches passwords to be stored between the electronic lock and the central unit.

9. A method according to claim 1, wherein an assignment password is matched on activation of the electronic lock.

10. A method according to claim 1, wherein, on activation of the electronic key, the central unit matches the electronic key identification code with the electronic key identification code stored in the central unit.

11. A method according to claim 1, wherein, on activation of the electronic key, an assignment password is saved in the memory.

12. A method according to claim 1, wherein the electronic key identification code is stored in an electronic key memory.

13. A method according to claim 1, wherein it is only possible to write to and read out from the electronic key memory when a security hash code is used.

14. A method according to claim 13, wherein, to save the external authorization code, the security hash code is determined by a processor in the electronic key.

15. A method according to claim 13, wherein, for reading out the external authorization code from the secured memory of the electronic key, a processor in the electronic lock generates a security hash code for accessing the secured memory.

16. A method according to claim 1, wherein a memory of a security processor is used as the memory in the electronic key.

17. A method according to claim 1, wherein status signals of the electronic lock are transferred to the electronic key for display.

18. A method according to claim 17, wherein the electronic key has a processor which controls signal elements for displaying the electronic lock statuses transferred by the electronic lock.

19. An electronic locking system comprising an electronic key and an electronic lock which are configured to be caused to interact with one another by a contact assembly and a mating contact assembly, the electronic key has a processor which interacts with an input unit by means of which an externally generated authorization code is transferable to the processor, the processor interacts with a memory and writes the externally generated authorization code into the memory and the electronic lock has a processor which, on interaction of the electronic key with the electronic lock via the contact assembly and the mating contact assembly, interacts with the memory in the electronic key in order to read out the externally generated authorization code; and wherein, prior to installation of the electronic lock at its intended location, the electronic lock is activated by the central unit, wherein in so doing the central unit matches the electronic lock identification code and the electronic lock cycle counter status with the identification code saved in the central unit and the stored cycle counter status.

20. An electronic locking system according to claim 19, wherein the memory is a secured memory and in that the processor of the electronic key generates a security code in order to save the externally generated authorization code in the secured memory.

21. An electronic locking system according to claim 19, wherein the processor of the electronic lock generates a security code in order to read out the authorization code saved in the secured memory.

22. An electronic locking system according to claim 19, wherein the electronic key has display elements in order to display electronic lock statuses transferred from the electronic lock to the electronic key.

23. An electronic locking system according to claim 22, wherein the processor of the electronic lock transfers status signals regarding the electronic lock statuses to the electronic key processor and in that the electronic key processor controls the electronic key display elements in accordance with the transferred statuses.

24. An electronic locking system according to claim 20, wherein the secured memory is the memory of a security processor.

25. An electronic locking system according to claim 19, wherein the electronic lock is operable by an electrical voltage source of the electronic key.

26. An electronic locking system according to claim 19, wherein the electronic lock comprises a locking drive for actuating a locking bolt.

27. An electronic locking system according to claim 26, wherein the locking drive of the electronic lock is operable by the electrical voltage source of the electronic key.

28. An electronic locking system according to claim 27, wherein the electronic lock has a voltage transformer in order to operate the locking drive.

29. An electronic locking system according to claim 19, wherein the electronic lock has a switch unit in order to activate or immobilize an external locking system.

30. An electronic locking system according to claim 19, wherein the electronic key has an interface for activating the electronic key by means of a central unit.

31. An electronic locking system according to claim 19, wherein the electronic lock has an interface for activating the electronic lock by a central unit.

32. An electronic locking system according to claim 30, wherein the electronic key and the electronic lock are activated by the central unit via a wired connection.

* * * * *